United States Patent [19]

Watkins et al.

[11] Patent Number: 4,918,797

[45] Date of Patent: Apr. 24, 1990

[54] METAL ROOF PANEL SEAMER APPARATUS

[76] Inventors: Neil A. Watkins, Rte. 5, Box 9; Peter M. Rook, Rte. 5, Box 69, both of Starkville, Miss. 39759; George Woodruff, Rte. 6, Box 248, Corinth, Miss. 38834

[21] Appl. No.: 312,733

[22] Filed: Feb. 17, 1989

[51] Int. Cl.[5] ..... B21D 37/00

[52] U.S. Cl. ..... 29/243.5

[58] Field of Search ..... 29/243.5, 243.57, 243.58; 72/48, 121, DIG. 1

[56] References Cited

U.S. PATENT DOCUMENTS

| | | | |
|---|---|---|---|
| 331,586 | 12/1885 | Wagenhurst . | |
| 1,976,148 | 10/1934 | Sonntag . | |
| 2,160,336 | 5/1939 | Maxfield . | |
| 2,171,297 | 8/1939 | Zahner et al. . | |
| 2,774,320 | 12/1956 | Boyd . | |
| 3,015,293 | 1/1962 | Parhan . | |
| 3,120,828 | 2/1964 | Gronlund . | |
| 3,487,799 | 1/1970 | Gronlund . | |
| 3,503,111 | 3/1970 | Janecek . | |
| 3,609,845 | 10/1971 | Taylor . | |
| 3,662,699 | 5/1972 | Horn et al. . | |
| 3,771,482 | 11/1973 | Thompson . | |
| 3,773,005 | 11/1973 | Day et al. . | |
| 3,797,430 | 3/1974 | Boudreau . | |
| 3,875,642 | 4/1975 | Knudson . | |
| 4,027,611 | 6/1977 | Ward et al. | 29/243.5 |
| 4,064,819 | 12/1977 | Fox . | |
| 4,072,118 | 2/1978 | Schultheiss . | |
| 4,324,031 | 4/1982 | Isenhoff . | |
| 4,372,022 | 2/1983 | Puckett . | |
| 4,470,186 | 9/1984 | Knudson . | |
| 4,562,721 | 1/1986 | Bleyer . | |
| 4,726,107 | 2/1988 | Knudson . | |

*Primary Examiner*—Robert C. Watson

*Attorney, Agent, or Firm*—Pravel, Gambrell, Hewitt, Kimball & Krieger

[57] ABSTRACT

A metal roof panel seaming apparatus which includes a main body portion that can be rolled along an unformed or partially formed seam, the body portion including a plurality of adjacent pairs of rollers, positioned along the underside of the body portion, one set of the rollers independent movable from a first position cammed away from the partially or unformed seam, to a second position cammed into the seam, for undertaking the seaming process. The second roll of rollers are stationary in position, and serve as drive rollers along the opposite side of the unformed or partially formed seam as the seam is crimped between the various pairs of rollers during the seaming process. There is further included, that the plurality of the two rolls of rollers provide a means for allowing the apparatus to move bi-directional and the ability to undertake the seaming process in either direction. The apparatus is able to undertake seaming in either direction along the roof panel and the seaming process may be initiated at any point along the length of the panel upon camming the rollers into position to undertake the seaming process.

9 Claims, 6 Drawing Sheets

METAL ROOF PANEL SEAMER APPARATUS

BACKGROUND OF THE INVENTION

1. Field of the Invention

The apparatus of the present invention relates to roof seamers. More particularly, the present invention relates to a self-propelled, bi-directional apparatus for forming a standing seam joining metal roof panels.

2. General Background

In the area of building construction, one of the most common current methods of constructing buildings is the utilization of metal panels that are aligned along their edges, against a metal frame, and the edges are formed or "seamed" in order to construct the enclosed structure. In such construction, one of the most critical areas where the seams must be properly formed between the panels is the panels which form the roof of the building. Of course, if the roof panels are not properly seamed, moisture, due to rain or the like, will seep between the panels, often causing rust and perhaps worst leaking through the panel seams, which may result in destruction of inventory or machinery housed within the building.

Therefore, there is an ongoing need for improvements in the type of seams that are formed between the panels, and more particularly, in the types of machinery or seamers that are utilized which in effect travel along the unseamed adjacent panels, and through a series of roller members, enable the seams to form as the apparatus is moved along the seam. Certain types of seamers are known in the art, and the most pertinent to the present invention are as follows:

U.S. Pat. No. 3,662,699 issued or Horn, et al., entitled "Metal Roof Seaming Machine" relates to an apparatus for forming a standing seam or adjoining adjacent metal roof panel having upstanding opposite margins with the seam being partially preformed prior to the apparatus engaging with the seam to complete the forming of the metal seam. This apparatus, in the first crimping step would include a pair of horizontally disposed rollers for crimping the partially formed seam along its horizontal axis, in the first crimping step.

U.S. Pat. No. 3,771,428 issued to Thompson, entitled "Seam Forming Machine" appears to include a cam actuated arrangement for moving at least one of the forming rolls toward another. The apparatus would include a single handle for engaging the rollers in the crimping function, as opposed to the present invention having independently operated rollers which would enable the apparatus to be bi-directional.

U.S Pat. No. 3,875,642 issued to Knudson, entitled "Seam Forming Apparatus", discloses a reversible self-propelled seam forming apparatus which includes first and second upper and lower seam forming rollers, which are vertically disposed in the seam forming function.

U.S. Pat. No. 4,726,107, likewise issued to Newton, entitled "Seaming Apparatus" discloses a seaming apparatus having a series of (4 drive) rollers on opposite sides of the seam to be formed, for forming the seam as the apparatus is moved along the seam. In this particular configuration, there includes an actuating means for moving a movable base toward and away from the main base between the engaging and disengaging positions as opposed to each of the rollers being independently controlled as with the present invention.

U.S. Pat. No. 3,797,430 issued to Boudreau, entitled "Seaming Tool" which utilizes a movable arm for moving the rollers from the disengaged to the engaged positions. As noted, however, the apparatus includes rollers which are positioned above and below the seam being formed as opposed to the present apparatus utilizing rollers on both sides of the seam being formed.

The remainder of the patents will be discussed more fully in the prior art statement which is being submitted herewith.

SUMMARY OF THE PRESENT INVENTION

The apparatus of the present invention solves the problems confronted in the art in a straight forward manner. What is provided is a metal roof panel seaming apparatus which includes a main body portion that can be rolled along an unformed or partially formed seam, the body portion including a plurality of adjacent pairs of rollers, positioned along the underside of the body portion, one row of rollers independently movable from a first position cammed away from the partially or unformed seam, to a second position cammed into the seam, for undertaking the seaming process. The second row of rollers are stationary in position, and serve as drive rollers along the opposite side of the unformed or partially formed seam as the seam is crimped between the various pairs of rollers during the seaming process. There is further included a plurality of the two rolls of rollers further provide a means for allowing the apparatus to move bi-directional, i.e., the ability to undertake the seaming process in either direction.

In the preferred embodiment, the apparatus would include a power source, such as a motor mounted on the body portion, for driving a drive chain to rotate the plurality of rollers during the seaming process, whether the rollers are in the cammed or uncammed position. Further, there would be included a handle portion for manipulation by the operator, to guide the apparatus as it would move along the seam, and for helping to support the apparatus as the apparatus moves along the very edge of the seam, prior to the apparatus being placed in the position to move the opposite direction to complete the forming of the seam.

Therefore, it is a principal object of the present invention to provide a seaming apparatus for forming metal roof seams, which is able to operate in a bi-directional manner, and where some of the rollers forming the seam operates independently of the other rollers;

It is a further object of the present invention to provide a bi-directional metal roof seamer, which may be placed at any point along the unformed or partially formed seam, and may operate in a first direction, and upon reversal of the drive motor, operate in the opposite direction to complete formation of the seam without the apparatus being removed from the seam, or without the need to manually form the seam at any point along the length of the seam;

It is a further object of the present invention to provide a formed metal roof seamer apparatus, which provides a double row of five adjacent pairs of rollers wherein the first three rollers from either end of the apparatus undertake the seaming process in their respective direction;

It is still a further object of the present invention to provide a metal roof seaming apparatus which forms a standing seam joining metal roof panels of the type having side plates that terminate upwardly with the pre-formed, partially closed, interlocking portion being bent to be substantially parallel with the plane of the panel, the apparatus having the ability to complete the formation of the seam as it moves along the entire length of the seam in either direction.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
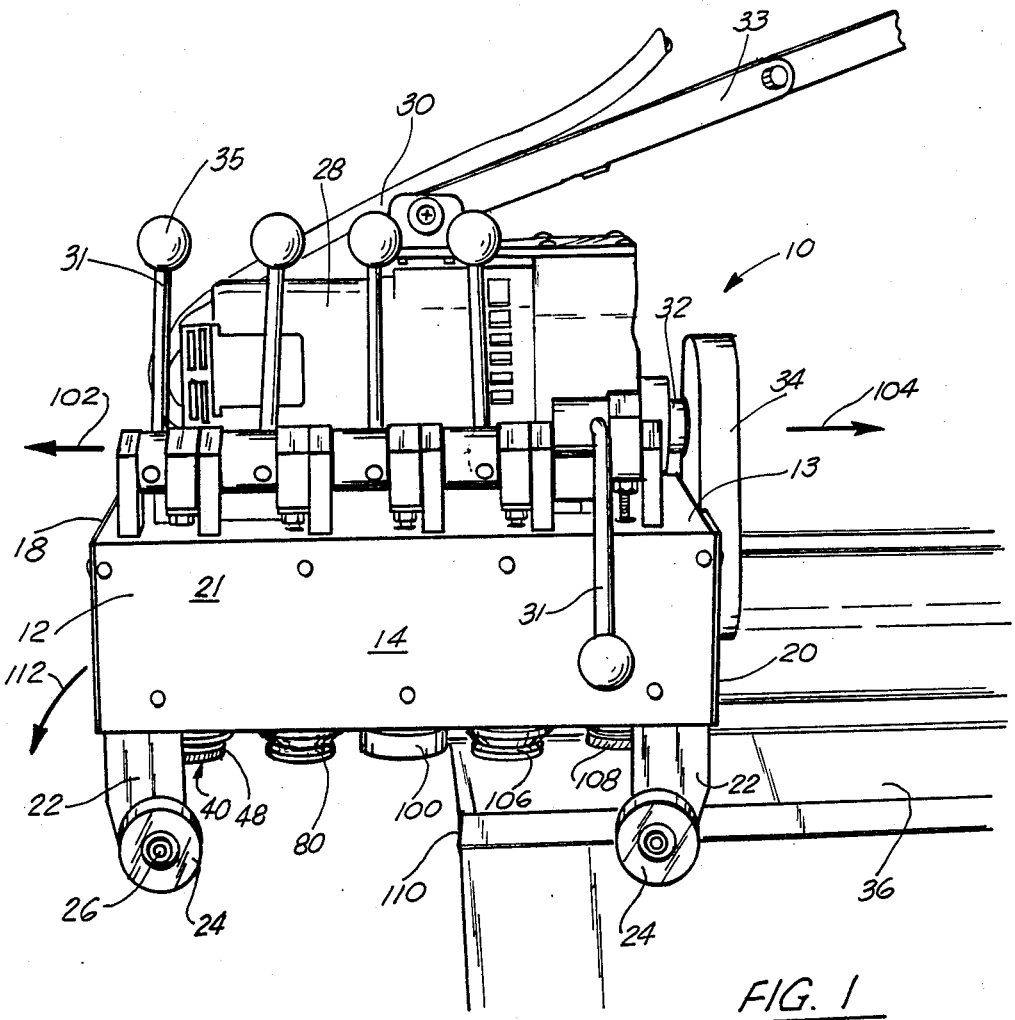
FIG. 1 is an overall view of a first principal embodiment of the apparatus of the present invention.

As seen in FIG. 1, the preferred embodiment of the apparatus is illustrated by the numeral 10. Seamer 10 would include a principal body portion 12 having a pair of side walls 14 and 16 (not illustrated), a first end 18 and second end 20, with each of the side walls and end portions provided with a cover plate 21, secured thereto, to form the rectangular box configuration as illustrated in FIG. 1. Body portion 12 would be supported by a plurality of leg members 22 each of the leg members 22 positioned at each corner of the body portion 12, and extending downward for accommodating a wheel member 24 rotatably on an axle 26 attached to each metal leg 22, for allowing the apparatus to roll freely along the surface during use. As further illustrated, the top surface 13 of body portion 12 would further support a drive means such as an electrically powered motor 28, which would be secured to the body portion 12, and would be supplied with energy through electrical line 30. For purposes of operation, motor 28 would be a bi-directional motor, which would allow the rotation of the motor shaft in either direction for the purposes to be discussed further.

As further illustrated, motor 28 would include a shaft 32 extending therefrom, having a conventional pulley wheel (not illustrated) on its end, for driving a drive chain contained within the body portion 12 of the apparatus, a function of which will be described further. Housing 34 is illustrated to provide a cover between the pulley at the end of drive shaft 32 and the drive train contained within the body 12 of the apparatus.

As further illustrated in FIG. 1, apparatus 10 is partially positioned upon a metal roof, of the type constructed of panels with metal seams that their edges, which apparatus 10 would be utilized to seam the edges in undertaking its function.

Figure 2:
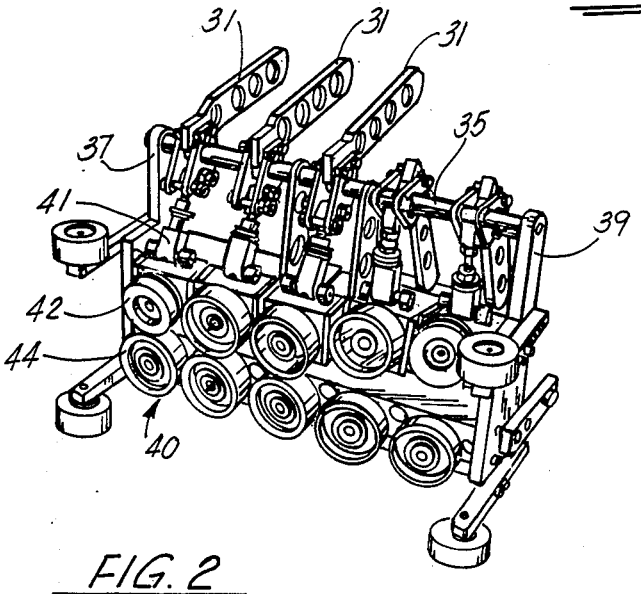
FIG. 2 is a partial-underside view of an additional principal embodiment of the apparatus of the present invention.

Further, as illustrated, apparatus 10 as seen in FIG. 1 in the first principal embodiment, and as seen more fully in FIG. 2 in the second principal embodiment, includes a plurality of seaming rollers 40. Each of the rollers 40 are assembled in a first row 42 and a second parallel row 44, each row 42, 44 including a plurality of or five rollers, each of the five rollers in row 42 adjacent a member roller in row 44 as illustrated in FIG. 2. For purposes of configuration, the rollers which would comprise row 42 would include a plurality of five independently operated rollers, each of the rollers movable from a first position cammed away from its adjacent roller in row 44, to its cammed position adjacent a rollers in row 44, during the seaming process. Furthermore, the rollers comprising row 44 would have no camming movement, on a stationary vertical axis, likewise each being independently driven, by the drive train as will be discussed further.

Figure 3:
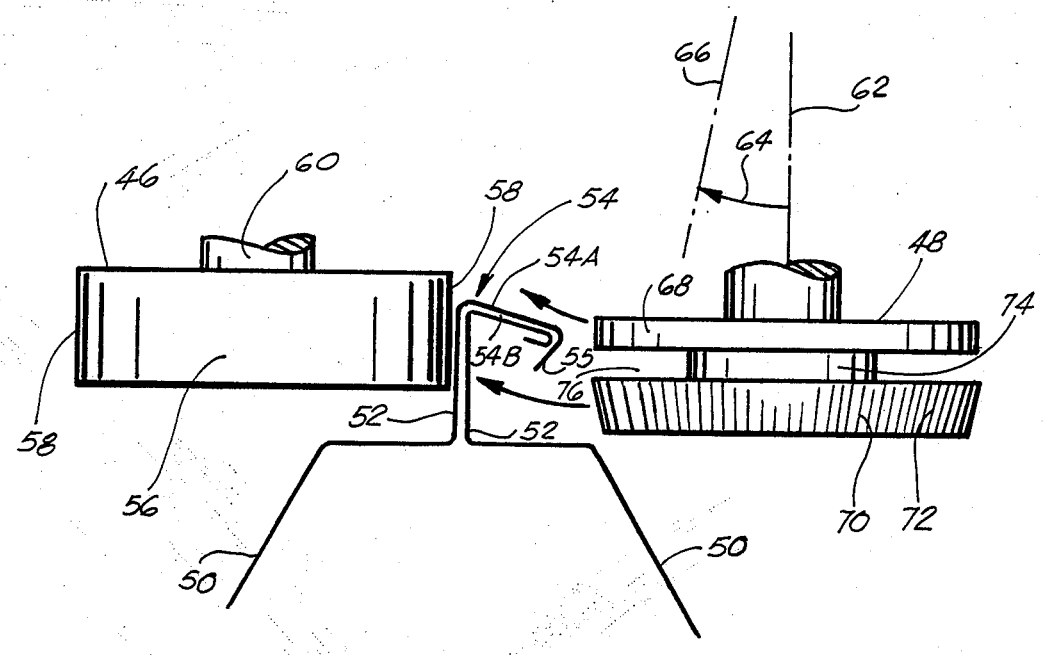
FIGS. 3–6 illustrate in isolated view, the formation of the upstanding seam from the partially unseamed position to the fully seamed configuration utilizing the apparatus of the present invention.

In order to properly explain the reasons for the camming action of the rollers which comprise row 42 on the underside of the apparatus, reference will be made to FIGS. 3–6 in the drawings. As seen in FIG. 3, there is illustrated a first roller 46, a second roller 48 positioned over a pair of roof panels 50, each of the roof panels 50 having a pair of standing sides 52 with the sides 52 partially pre-formed and enclosed portions 54A and 54B, to define partially formed seam 54. The interlocking portion 54A is formed over and around the lower interlocking portion 54B, to be positioned substantially parallel to the plane of the panel. In this configuration, the panels are set in place, with the upstanding portions 52 manually positioned as seen in FIG. 3. Rollers 46 and 48 illustrate the position of the rollers as the apparatus 10 is placed straddling the unformed seam of the panels 50, prior to being engaged into operation. This ability to straddle partially seam 54 enables the apparatus to begin the seaming process at any point along the length of the partially formed seam.

At this point all rollers in rows 42 and 44 are cammed away from one another to define the space between which the partially formed seamed 54 would be positioned prior to seaming. As illustrated, roller 46, is the first forward roller contained in row 44. Each of the rollers 46 in row 44 comprising a continuous annular wall portion 56, having a flat surface 58, and rotating upon a shaft 60 driven by the drive train contained in the body of the apparatus. For purposes of operation, each roller 46 would be positioned so that its outer surface 58 is positioned against the standing edge 52 of panel 50 which is nearest roller 58 as illustrated.

Figure 4:
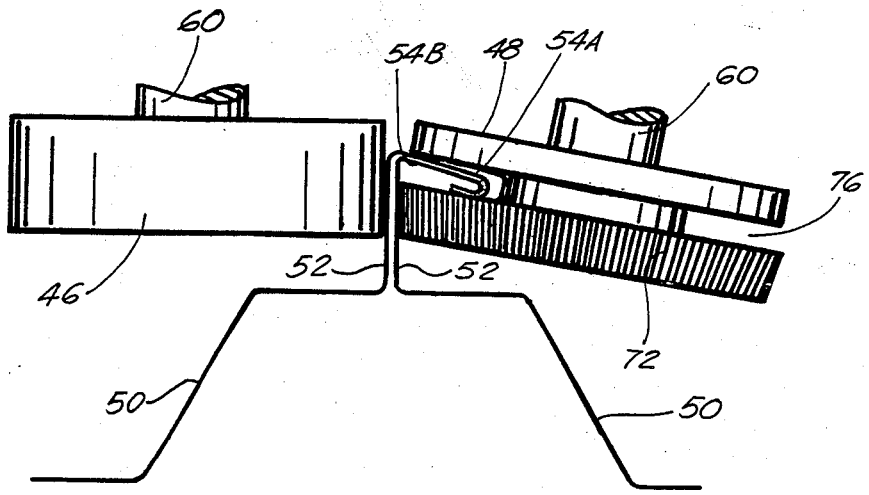

Further illustrated in FIG. 3 is a second roller 48, which is the lead roller comprising row 42 of the apparatus. Roller 48, as illustrated in FIG. 3, is cammed away from partially formed seamed sides 52 along an axis 62, and having the ability to be cammed inwardly along the direction of Arrow 64 to a position along axis 66, during the first steps of the seaming process. As illustrated, roller 48 includes an upper roller portion 68, a lower roller portion 70, with a lower roller portion 70 having a plurality of knurled edge 72 serving to pull the apparatus along during the seaming process. Intermediate upper portion 60 and lower portion 70, there is defined a centrally located portion 74, for defining a space 76 therebetween, so that as roller 48 is cammed to the position along axis 66, the outer edge 55 of upper partially formed seam 54A is formed inwardly around the inner seam 54B as illustrated in FIG. 4. This movement, of course, of roller 48 from the position as seen in FIG. 3 to the first crimping step position as seen in FIG. 4, would be done manually by the movement of one of the handle members 31 contained upon the body portion 12 as illustrated in FIGS. 1 and 2.

As further illustrated in FIG. 4, roller 48, has been moved to the fully cammed position wherein the end portions 54A and 54B of upstanding portions 52 of panels 50 undergo a first crimping within space 76, and furthermore knurled edges 72 forced against the outer surface of side 52, propels apparatus 10 along the roof, during the crimping process.

Figure 5:
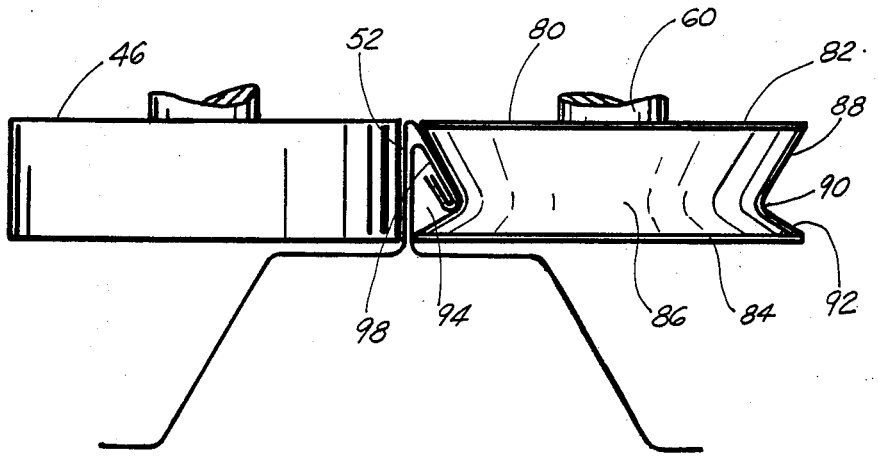

Turning now to FIG. 5, there is illustrated the second adjacent pair of rollers 46 and 80, roller 46 being identical to first roller 46 within row 44, and serving to undertake the same function as first roller 46, therefore no further discussion will be had of that particular roller. However, roller 80 in row 42, as noted in FIG. 5, likewise is supported by a shaft 60, and includes an upper surface 82, a lower surface 84, with a recessed crimping surface 86 therebetween. Crimping surface 86 provides an upper inwardly depending angular shoulder 88, extending from surface edge 82, to form an inner most recess 90, and to return to a lower outwardly depending edge 92 interconnecting with lower surface 84. As illustrated, the concave shape of edge 86 defines a space 94 within which the crimped edges 54A, 54B as seen crimped in FIG. 4, can be fed. Crimped edges 54A, 54B are moved from a substantially parallel position with the plane of panel 50, (FIG. 4) to a position of substantially 45° from the vertical to form a seam 98, as roller 80 would undertake further crimping of the edges as the apparatus moves there along, as seen in FIG. 5.

Figure 6:
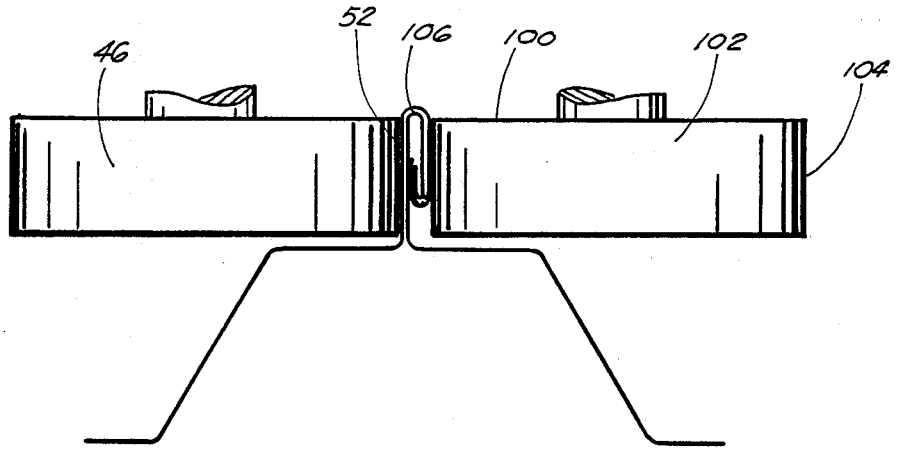

Turning now to FIG. 6, again there is illustrated the third roller 46 within row 44, again being identical to the first and second rollers as previously described in FIGS. 4 and 5, and likewise serving as a flat surface against which edge 52 is retained. It's adjacent partner roller 100 would likewise have substantially a continuous annular wall portion 102, forming a flat surface 104 against which the partially crimped seam 98 which forms the seam as illustrated in FIG. 5 would encounter, to move the seam from the 45° position as illustrated in FIG. 5 to the fully crimped vertical position as illustrated in FIG. 6. Therefore, following the movement of roller 80 through the partially crimped seam 98, there would be formed a fully crimped seam 106, and therefore the apparatus has completed crimping process.

For purposes of further explanation, reference is made to FIGS. 7–10 which illustrate, through underside view, the movement of the three first rollers 46 that comprise row 44 and the sequential movement of the three rollers 48, 80, and 100, which comprise the three adjacent rollers in the respective positions. As is illustrated, for example, in FIG. 7, the apparatus would be set in place on the partially crimped seam as illustrated in FIG. 3 prior to the seaming operation commencing with rows of rollers 42, 44 in the fully uncammed position.

Figure 7:
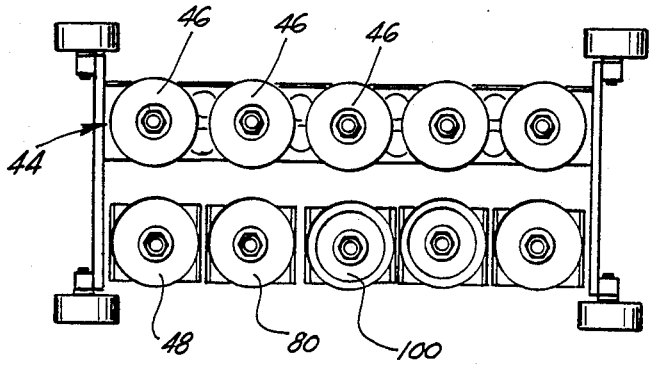
FIGS. 7–11 illustrate an underside view of the preferred embodiment of the apparatus of the present invention during the seaming process.
Figure 8:
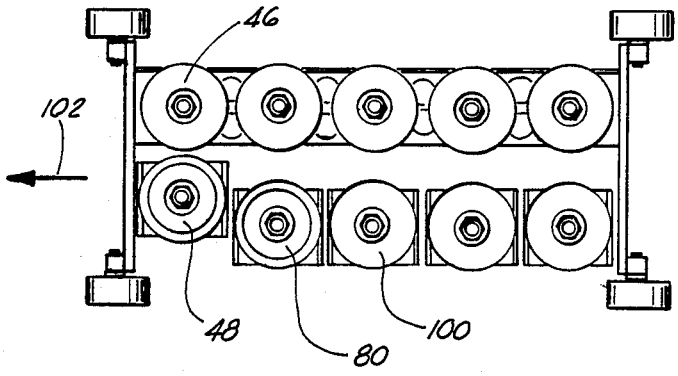
Figure 9:
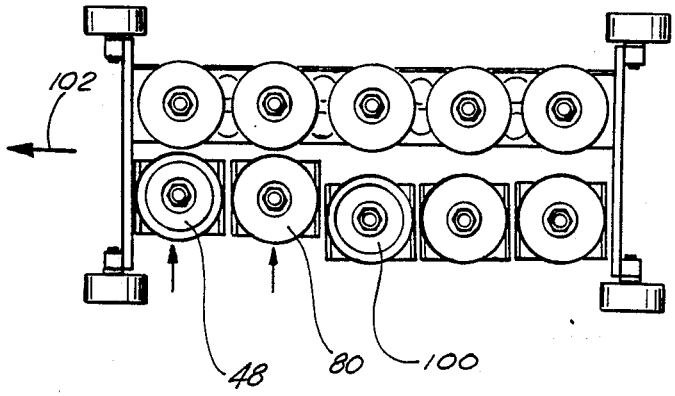
Figure 10:
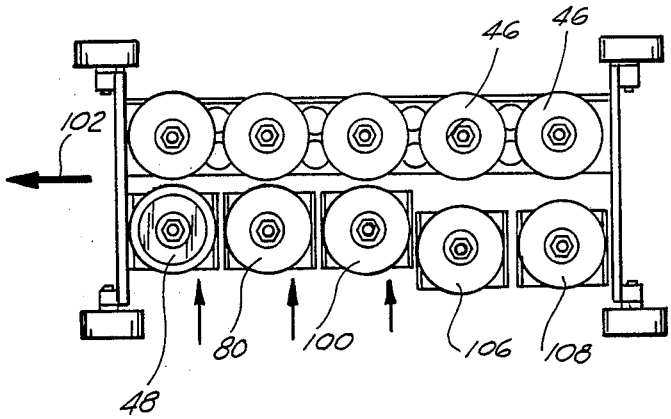

Turning now to FIG. 8, roller 48 has moved from the first non-crimping position as seen in FIG. 7, to the fully cammed position as seen in FIG. 8, and is undertaking the crimping process as is illustrated in FIG. 4. Turning now to FIG. 9, following the initial crimping as illustrated in FIG. 4, roller 80 is likewise engaged into the camming position via handle 31, and is undertaking that portion of the seaming process that is illustrated in FIG. 5. Following the apparatus having moved further along the seam, roller 100 is then manually cammed into place via handle 31 as illustrated in FIG. 10, and is therefore undertaking the final crimping step as is illustrated in FIG. 6 of the drawings. Therefore, as the apparatus has been moving in the direction of Arrow 102 as illustrated in FIGS. 8, 9, and 10, each roller 48, 80, and 100 has been manually cammed into the position in order to crimp the edges from the partially uncrimped position as illustrated in FIG. 3 to the fully crimped position as illustrated in FIG. 6, thus completely forming the finished edge. Therefore, of the five rollers that comprise each row 42, 44, respectively, as illustrated in sequence, only the first three sets of rollers 48, 80, and 100 of row 44, and rollers 46 of row 42 are utilized to undertake the complete crimping and finishing of the edge.

Figure 11:
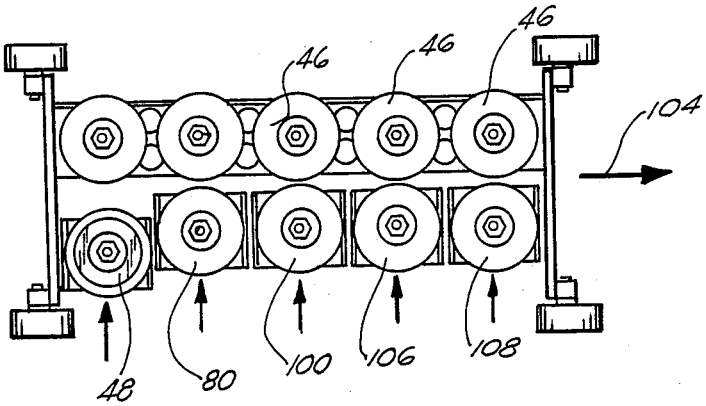

At this point, reference is made to FIGS. 10 and 11, and more particularly FIG. 11, where it is illustrated that following the crimping of the edge in the direction of Arrow 102, where the machine has crimped a certain length of edge, motor 28 of the apparatus may be placed in the reverse position, thus allowing the apparatus to move in the opposite direction or in the direction of Arrow 104 as illustrated in FIG. 11. In order to undertake crimping in this particular manner, reference is made to the two additional rollers 46, in row 42 of the apparatus, and rollers that will be designated 106 and 108 in row 44 of the apparatus. As illustrated, in the configuration of the apparatus, roller 108 undertakes the identical tasks as roller 48, as illustrated in FIGS. 3 and 4 of the drawings, and subsequent roller 106 likewise takes on the identical tasks and is of the identical configuration of roller 80, as illustrated in FIG. 5 of the drawings. Likewise, roller 100, which is the centrally located roller between the two identical pairs of rollers 48, 80, and 106, and 108, of course would take on the same tasks as is illustrated in FIG. 6, i.e., to finish off the crimping process, whether the apparatus was moving in the direction of Arrow 102 or in the direction of Arrow 104.

Therefore, as illustrated in FIG. 11, when the apparatus is moving in the direction of 104, i.e., after it has undertaken the complete crimping process of a portion of the edge in the direction of Arrow 102, roller 108 would be engaged against first roller 46, second roller 106 would be engaged against second roller 46, and finally roller 100 would be engaged against roller 46 in order for the apparatus to crimp in the direction of Arrow 104. For purposes of information, roller 80, due to its configuration, could be maintained in the cammed position as illustrated in FIG. 11, when the apparatus is moving in the direction of 104 in view of the fact that the seam is already fully crimped after being crimped by roller 100, and therefore, roller 80 would not interfere with the seam. However, roller 48 due to its unique configuration should be in the uncammed position as the apparatus is moving in the direction of 104 so that it would not interfere with the crimped seam as the apparatus moves along the edge. The same is true for roller 108 when the apparatus moves in the direction of Arrow 102.

Figure 12:
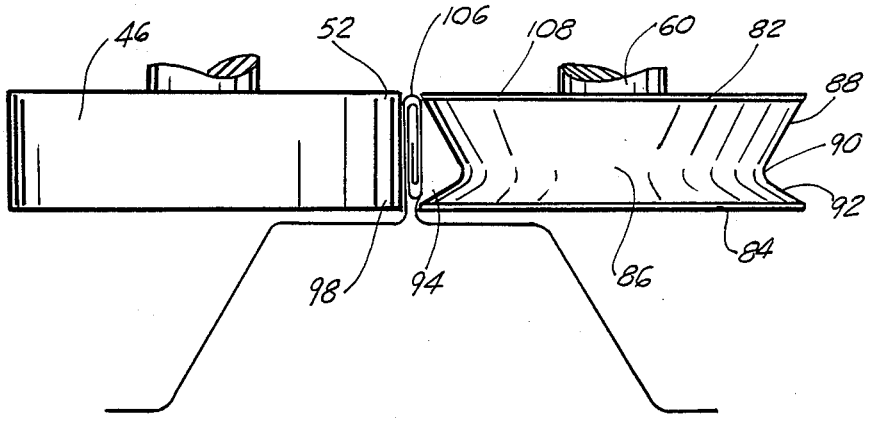
FIG. 12 illustrates a front view of the apparatus of the present invention straddling a formed seam along the outer edge of a pair of seamed panels.

Returning to FIG. 1 of the drawings, one of the unique features of the apparatus is the ability of the apparatus to straddle beyond the edge 110 of the roof panel 36 after the crimping process has been undertaken. This is an important feature in view of the fact that in the present state of the art, in order to properly crimp along the edge of a roof panel, usually requires that a manual crimping tool be utilized at the edge of the roof panel since the apparatuses that are known cannot go beyond a certain part of the roof edge. However, due to the fact that the present apparatus includes a series of five rollers along its length, each independently cammed via handles 31, this problem is solved. In operation, apparatus 10 would be placed at any point along the length of partially crimped edges after panels 36 have been put into position as illustrated in FIG. 3. The apparatus would then be engaged to operate in a particular direction, for example in the direction of Arrow 102, and first roller 48 would be engaged as illustrated in FIG. 8. As the apparatus is moved along rollers 80 and 100 and 106 would be engaged in sequence to fully crimp along the edge of the panel as the apparatus moved in the direction of Arrow 102. In FIG. 1, it is illustrated that apparatus 10 has completed the crimping along the edge of the panels 36, and as is illustrated, rollers 48, 80, and 100 have moved past end edge 110 of the panels, and therefore the panels are crimped up to the very edge 110, with a greater portion of the apparatus extending outwardly from edge 110 and held in place by handle member 33, and as seen in FIG. 12, by engaged roller 106, whose lower beveled face 92 has engaged the lowermost turn of crimped edge 106 and therefore is assisting supporting the apparatus from falling in the direction of Arrow 112, as illustrated in FIG. 1. Therefore, following the apparatus completing the seaming of the edge past the edge 110, the motor 28 would then be placed in the reverse position, and the apparatus would return in the direction of Arrow 104 to be supported by all four wheels 24, and at the point that the partially crimped seam 52 would be engaged by roller 108, the crimping would resume in the opposite direction with rollers 106, 108, and 100 undertaking the crimping sequence as illustrated in FIG. 11.

Figure 13:
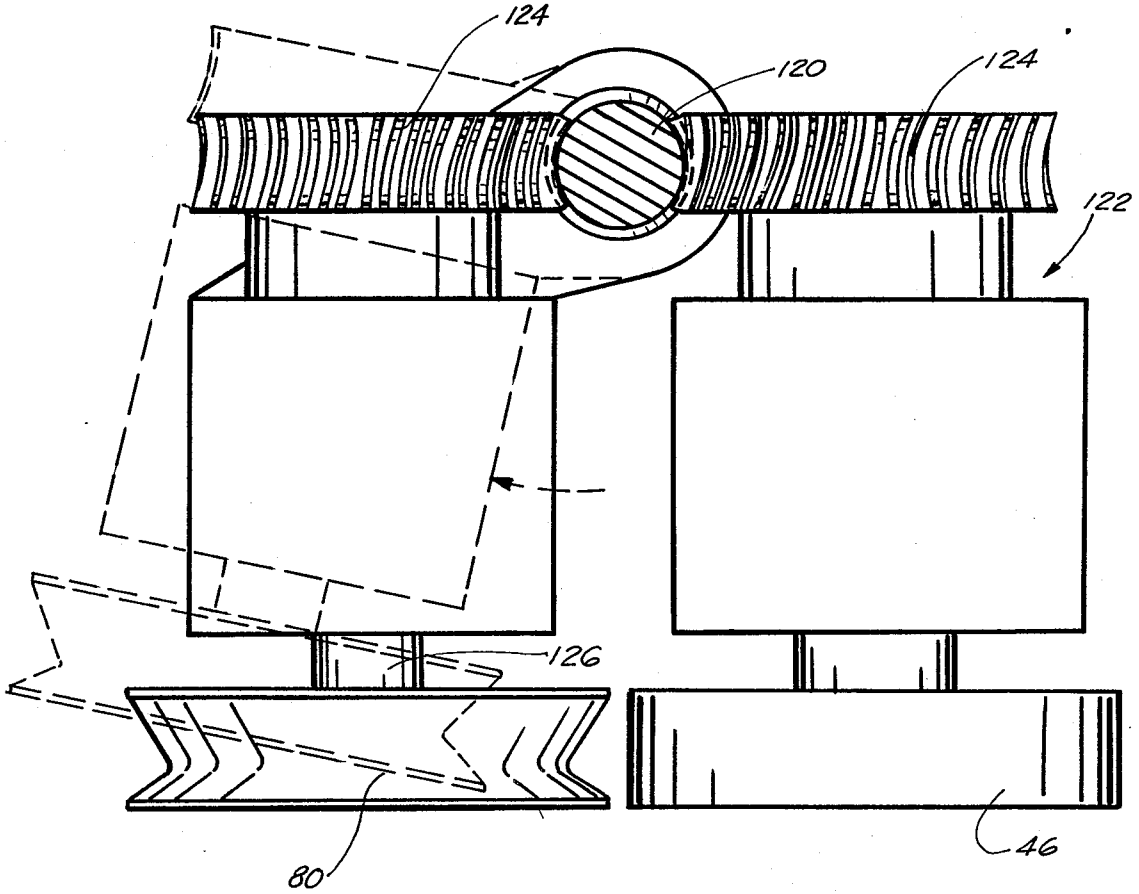
FIG. 13 illustrates in cross-sectional view of the drive train of the apparatus of the present invention in driving the rollers while the rollers are in a first uncammed to a second cammed seam forming position.

Returning to the drive train mechanism, FIG. 13 properly illustrates the relationship between the drive train and the independently operated roller members in apparatus 10. As illustrated, the drive train would comprise a worm gear 120 extending along the length of apparatus 10, and driven via pulley belt or the like interconnected to a pulley wheel at the end of shaft 32 as illustrated in FIG. 1. Shaft 32 would impart rotation to worm gear 120, which would along its length engage each of the roller components 122 in order to rotate the various rollers for example, in FIG. 12, rollers 46 and roller 80 as illustrated. Component 122 would further comprise gear member 124 rotatable on a vertical axis, connected to shaft 126, so that as worm gear imparts rotation to gear 124, shaft member 126 is likewise rotated to impart rotation to the particular roller. As further illustrated in FIG. 12, upon manual manipulation of the handle members in order to control the camming or the movement of the movable rollers of the cam to the uncammed position, gear members 124 continue to engage wherein the gear 120, and would continue to rotate as long as motor 28 is energized.

As illustrated in FIG. 1, the camming sequence is undertaken via a plurality of handle members 31, each of the handle members 31 having an upper handle portion 35 for manually engaging with one hand, so that the movement of each of the five handle members 31 as illustrated in FIG. 1 would likewise impart camming action to each of the five roller members coinciding to the particular handle member engaged or disengaged between up and down positions. For example, as illustrated in FIG. 1, four of the handle members 31 are in the up position, therefore roller members 48, 80, 100, and 106 are cammed to undertake the seaming process, while a fifth handle 31 is in the down position, and therefore roller member 108 is cammed away from the seam, so that it is not undertaken seaming, yet is still rotating due to continuous engagement with rotating worm gear 120.

In the second principal embodiment in FIG. 2, the only modification between that embodiment and the first principal embodiment is the fact that the engagement is through a linkage wherein each of the handle members 31 are linked across a continuous bar 35 extending along the length of the apparatus and mounted upon a pair of mounting struts 37 and 39 respectively. Each of the handle members are likewise linked to an arm member 41 so that movement of the handle members between a first down position as seen in FIG. 2, by three handle members to a certain up position as illustrated by two of the handle members, the down position imparts camming movement to the rollers to engage the rollers to undertake seaming of the unwanted seam, wherein the handle members 31 are in the up position as illustrated in FIG. 2, the rollers are cammed outwardly away from rollers 46 and therefore are not undertaking seaming of the seams at this point.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A self-propelled, bi-directional apparatus for forming a standing seam joining metal roof panels, of the type having side portions that terminate upwardly with a preformed partially closed interlocking portion to be substantially parallel with the plane of the panel, the apparatus comprising:

(a) a support frame;

(b) a first plurality of drive rollers, positioned along the frame for contacting an end portion of a panel;

(c) a second plurality of seam forming rollers, positioned along each side of the drive rollers, and moveable a sufficient distance from the corresponding drive roller to straddle the unformed seam between the drive roller and the seam roller;

(d) means for camming each seam roller independently of the other seam rollers to a second position to engage into the seam between the first pair of seam and drive rollers;

(e) means for camming each subsequent seam roller against its corresponding drive roller to form the seam from its first unseamed configuration to its formed configuration; and (f) a third plurality of rollers for allowing the machine to move in the opposite direction when the third plurality of rollers are engaged against the seam.

2. The apparatus in claim 1, wherein the first pair of rollers engage the seam edge to pinch the second seam edge to a closed position.

3. The apparatus in claim 1, wherein the second pair of rollers crimp the edges to form a seam from a position substantially parallel with the plane of the panel to a position substantially at a 45° angle from the plane of the panel.

4. The apparatus in claim 1, wherein the third pair of rollers engage the seam side to move the seam sides from the 45° angle relative to the plane of the panel to a full stand up seam perpendicularly closed between the panels.

5. An apparatus for forming a standing seam joining metal roof panels, the type of panel having side portions that terminate upwardly with a pre-formed partially closed interlocking portion to be substantially parallel with the plane of the panel, the apparatus comprising:

(a) a principal body portion;

(b) a first row of drive rollers, positioned along the length of the principal body portion, each of the rollers in contact with one of the upwardly terminating end portions of a panel;

(c) a second row of rollers, positioned along the length of the principal body portion, each of the second row of rollers coinciding with a roller in the first row of drive rollers;

(d) means for camming each of the rollers in the second row of rollers independently of one another, from a first unengaged position, to a second position wherein the roller is engaged to the seam, partially forming the seam between a roller in the first row of rollers and a roller in the second row of rollers;

(e) means for camming each subsequent row in the second row of rollers against its corresponding roller in the first row to completely form the seam from its partially formed configuration to its formed configuration; and (f) a fourth and fifth roller positioned in the second row of rollers, for allowing the apparatus to move in the opposite direction, so that the seaming process may be undertaken on the fifth, fourth and third rollers respectively.

6. The apparatus in claim 5, wherein the first roller on the second row of rollers engage and crimp the seam to a partially closed position substantially parallel with the plane of the panel.

7. The apparatus in claim 5, wherein the second roller in the second row of rollers crimp the seam to configure the seam from the position in claim 6, to a position substantially at a 45° angle from the plane of the panel.

8. The apparatus in claim 5, wherein a third roller in the second row of rollers engages the seam from the configuration in claim 7, and configures the seam to a fully standing closed position perpendicular to the plane of the panel.

9. An apparatus for forming a standing seam joining metal roof panels, of the type having side portions that form upwardly with a partially pre-formed, partially closed interlocking portion that is substantially parallel with the plane of the panel, when the seam is in the unseamed configuration, the apparatus movable along the metal roof panels;

(a) a body portion positionable on wheels at any point along the length of the partially formed seam to be formed;

(b) first and second set of rollers positioned beneath the body portion, and spaced apart so that the partially formed seam is positionable between the first and second set of rollers;

(c) means for camming one set on the rollers, between a first position wherein the rollers are not contacting the partially formed seam, to a second cammed position wherein each roller is independently cammed toward the partially formed seam partially configures the seam from the partially formed configuration to the totally formed configuration as each of the rollers are cammed independently during the seaming process; and (d) means for powering the operation in either direction so that the seaming process can take place in either direction that the apparatus is moved, depending on the direction of rotation of the rollers during use; and (e) a third set of rollers for allowing the machine to move in the opposite direction when the rollers are engaged against the formed seam.

* * * * *